United States Patent [19]

Sowards et al.

[11] Patent Number: 5,060,584

[45] Date of Patent: Oct. 29, 1991

[54] FLUIDIZED BED COMBUSTION

[75] Inventors: Norman K. Sowards; Michael L. Murphy, both of Coeur d'Alene, Id.

[73] Assignee: Energy Products of Idaho, Coer d'Alene, Id.

[21] Appl. No.: 542,229

[22] Filed: Jun. 22, 1990

[51] Int. Cl.[5] ..... F23G 5/00

[52] U.S. Cl. ..... 110/245; 432/58; 110/235

[58] Field of Search ..... 110/245, 235; 432/58, 432/15

[56] References Cited

U.S. PATENT DOCUMENTS

| | | | |
|---|---|---|---|
| 3,834,326 | 9/1974 | Sowards | 110/8 R |
| 4,060,041 | 11/1977 | Sowards | 110/8 F |
| 4,075,953 | 2/1978 | Sowards | 110/8 F |
| 4,253,824 | 3/1981 | Foote | 432/58 |
| 4,308,806 | 1/1982 | Uemura et al. | 110/245 |
| 4,346,661 | 8/1982 | Nakamura | 110/235 |
| 4,352,332 | 10/1982 | Baston | 110/346 |
| 4,359,005 | 11/1982 | Baston | 110/245 |
| 4,411,879 | 10/1983 | Ehrlich et al. | 432/15 |
| 4,448,134 | 5/1984 | Foote | 110/245 |
| 4,553,487 | 11/1985 | Rasmussen et al. | 110/245 |
| 4,565,138 | 1/1986 | Ueda et al. | 110/346 |
| 4,572,082 | 2/1986 | Ueda et al. | 110/245 |
| 4,576,102 | 3/1986 | Rasmussen et al. | 110/346 |
| 4,693,682 | 9/1987 | Lee et al. | 110/245 |
| 4,716,856 | 1/1988 | Beisswenger et al. | 110/245 |
| 4,757,771 | 7/1988 | Narisoko et al. | 110/245 |
| 4,773,339 | 9/1988 | Garcia-Mallol | 110/245 |
| 4,981,111 | 1/1991 | Bennett et al. | 110/245 |

*Primary Examiner*—Henry C. Yuen
*Attorney, Agent, or Firm*—Lynn G. Foster

[57] ABSTRACT

A continuously operable fluidized bed vessel system and method for incinerating and disposing of materials which produce high tramp residue. The system is particularly effective in combusting shredded tire and disposing of large amounts of wire tramp without requiring down-time for cleaning. Emission of undesirable gases is controlled by a sensing and controlling system which provides for automatic injection of combustion by-product-modifying gases and solids. Further control of undesirable gas emission is controlled by employing sealed combustible material input and solid waste output ports. Fluidizable bed material which is entrapped and discharged with the other residue is separated from magnetic tramp and larger grain sized non-magnetic tramp and recycled to continuously replenish the fluidized bed. The bottom of the fluidized bed comprises layers of sloping, overlapping plates which offer no impediment to movement of wire and other tramp moving downwardly, away from the periphery of the vessel, toward a discharge chute and which may be numerically increased to form the bottom of a vessel of unlimited size. The wire and other tramp are continuously urged toward the discharge chute by gravitational force combined with air streaming from spaces between the overlapping plates in the downward plane of the plates. The same air stream ultimately vectors upward toward the vessel outlet to provide support for the fluidized bed.

23 Claims, 4 Drawing Sheets

FLUIDIZED BED COMBUSTION

FIELD OF INVENTION

The present invention relates generally to incineration or pyrolysis of waste and more particularly to smokeless, low pollution fluidized bed combustion of pieces of solid organic waste containing a large amount of difficult to handle noncombustibles and, especially, of waste such as shredded tires which produce tramp in the form of wire which may ball or otherwise cumulate and become immobile in incinerators having central structural impediment beneath the fluid bed inhibiting movement of the tramp from the incinerator. More specifically, the present invention relates to a novel sloping fluidized bed vessel bottom which provides no impediment to tramp moving downwardly toward a removal site at the deepest point of the bed bottom and yet effects airflow adequate to support the fluid bed material while allowing incoming, nozzled airflow and the force of gravity to progressively remove tramp and a small amount of bed material from the bed. In addition, a novel fluidized bed material recovery system separates the removed bed material from the removed tramp and recycle the separated bed material to the vessel for further use.

PRIOR ART

While low pollution fluidized bed incineration systems are finding ever greater application in eliminating organic waste, there remain numbers of combustible materials for which incineration systems heretofore have been ineffective. The difficulties of disposing of waste tires comprising large amounts of non-combustible wire and other tramp is a prime example. There is some combustion of tires being practiced wherein tires are being used not as the primary fuel but as a fuel supplement. In these cases, however, tires are most often being used where the high temperature slags the wires during combustion or where the tires are dewired during the shredding process. Unless either of these two processes is used, periodic removal of wires from the incinerator requires significant downtime after incinerator shut down.

It is estimated that over 200 million tires per year are disposed of in some form or recycled for retreading or reuse. Of this 200 million, which equates to nearly one tire per person in the U.S., roughly 36 million are retreaded, 10 million recycled for reclaiming the rubber, and 5 million are currently being used as a fuel supplement in various energy system operations. The remaining 75 percent or nearly 150 million tires per year, are directed to landfill or stored openly, creating unsightly, unsafe and ever growing mounds of waste tires. These tires are currently creating environmental problems which ofttimes are of calamitous proportions. Numerous local communities have experienced acrid pollution of their atmospheres due to nearly impossible to-extinguish fires which seems to be occurring with increasing frequency. Fire fighters have been imperiled trying to control these fires. Significant mosquito problems have erupted as the result of long dwelling water in tire wells.

The latent energy which can be derived from tire rubbish is enormous. Each tire can supply 300,000 BTU's of energy. Considering the number of tires going to landfall or open storage annually, this equates to 43.5 trillion BTU's per year. On the basis of typical power plant cycle efficiency, this energy is sufficient to generate approximately 3 million megawatt hours of electricity per year. This estimate does not include tires already accumulated in landfill and tire graveyards throughout the country.

As can be appreciated by reference to U.S. Pat. No. 4,576,102, continuously operating fluidized bed incineration systems typically require a fluid bed vessel, a fluidizing air distribution structure, bed material of predetermined depth, a preheater, an ongoing source of fuel distributed throughout the bed, and a means for continuous or regular removal of any non-combustible material or tramp which may collect and hamper operation. When considering the special problems created by fuels having high concentrations of inert materials, most notably, fuels such as tire chips with high concentrations of wire strands, problems not previously solved by prior art becomes evident. These problems are particularly evident when considering vessels which comprise no moving parts.

Wire strands tend to accumulate and form high density masses and bundles which inhibit fluidization. Collecting masses of wire and like tramp are not mobile in the sense of most rocks and other tramp. Any edge or structure upon which a wire may catch can be the point of beginning of a balling mass which ultimately will grow to significantly impede fluidization, forming high density masses and bundles which will not obey removing forces within the vessel. Also wire strands and like tramp tend to ball and collect in stagnant areas of the system. The significance of the problem of wire disposition from fluidized bed systems is evidenced by the fact that wire makes up ten percent of tire mass by weight.

One of the primary problems addressed in prior art has been keeping tramp and fluidizable bed material out of the air plenum while providing uniform supporting airflow below the base of a fluidized bed. Standoff nozzles above a tramp removal system is described in U.S. Pat. No. 4,060,041. A dual cone system comprising holes in the upper cone for downward tramp flow to the lower cone is described in U.S. Pat. No. 4,253,824.

An approach to limiting tramp and fluidizing material which may fall into the air distribution plenum below a bed support structure and otherwise collect in the fluidizing air distribution system is presented in U.S. Pat. No. 4,576,102. Each outlet nozzle, which is orthogonal to the distribution structure, is fitted with a tube which is formed into a "U" similar to that used in a liquid sewer connection to limit the amount of material which may collect and clog the nozzle. The size and depth of the volume in which material may collect is limited to the amount which may be ejected by the force of bed fluidizing airflow provided through each outlet.

In all known prior art which applies to fluidized bed incinerating vessels, provisions for emission of fluidizing air have resulted in structures or areas of stagnation which provide the opportunity for wire and like tramp to accumulate, to form balling masses, and ultimately, to require an otherwise continuous incineration process to undergo periodic termination of operation for cleaning.

A thermal decomposition furnace in which waste tires having their original unaltered shape can be laid horizontally and be thermally decomposed is described in U.S. Pat. No. 4,572,082. While this relates a method for decomposing and removing tramp of whole tires, it does not solve the problems associated with incineration of tire chips and is severely restricted in size and throughput due to a limitation in the combustion portion of the vessel to an internal diameter of less than that of a tire.

Prior art for fluidized bed vessels generally deals with use of airflow primarily directed upward to support the fluidized bed. In U.S. Pat. No. 4,576,102 airflow is directed out of a downwardly sloping bed support structure wherein it is stated, "Fluidizing air and gravity alone gently walk tramp material downwardly along the top of the top of the bed support structure toward a discharge site. Although the discharge of fluidized air through the grid plate into the bed may be non-vertical, the horizontal component of said air discharge is immediately dissipated and the bed turbulence or direction of fluidization is essentially vertical." The discharge of fluidized air through the grid plate is essentially orthogonal to the grid plate and not vertical because the grid plate is sloped. The airflow which originally flows directly upward away from the plane of the discharge plate provides lifting force which "gently" aids gravity in "walking" the material downwardly.

Some non-vertical airflow has been used. For example, horizontal airflow in regions above the discharge plate is used as described in U.S. Pat. No. 4,060,041 to create a vortex to increase the residence time, prevent channeling, and centrifuging airborne solid particles. However, in no known prior art is airflow vectored to directly accommodate tramp displacement toward a disposal means.

Continuous incineration processes also must contend with loss of fluidizable bed material entrapped in tramp and otherwise depleted, such as through the gaseous exhaust system. To recycle fluidizable bed material, wire and large, non-fluidizable tramp must be segregated after removal.

Incineration of tire chips is mentioned above in an exemplary way, since waste comprising auto shredded residue, municipal and industrial waste and the like which contains large amounts of difficult to handle noncombustibles present a similar problem. Nevertheless, heretofore fluid bed incineration of tire segments as a principal fuel has not been possible on a continuing basis, because tramp wire from the tire segments tends to accumulate into a bird's nest ball in the fluid bed and, therefore, continuous removal of the wire was heretofore not achieved. Consequential fluidization of the bed is impaired, creating poor fuel/air distribution and causing eventual shutdown of the fluid bed system.

BRIEF SUMMARY AND OBJECTS OF THE INVENTION

In brief summary, this invention alleviates all of the known problems related to incineration of waste containing large amounts of difficult to handle noncombustibles, such as tire chips, auto shredded residue and municipal and industrial waste. It provides a system which can operate continuously, receiving fuel having a high, difficult to remove tramp content delivered to the vessel by a combustible material delivery system, controlling and reducing release of undesirable exhaust gases at or below environmentally acceptable levels, moving tramp to a discharge chute without accumulating work-stopping tramp which inhibits fluidizing processes, and discharge noncombustibles (tramp) through a discharge separation system which recycles entrapped fluidizing bed material. The present invention, in a primary way, comprises an air distributor disposed at the bottom of a fluid bed vessel which is centrally hollow and is tapered downwardly and inwardly in steps or tiers whereby a plurality of layers of air are directionally issued peripherally to support and fluidize the bed and displace the tramp toward the hollow center of the distributor.

Restated, major problems related to balling and/or accumulation of wire and like tramp are solved by a novel centrally hollow fluidizing air structure disposed at the bottom of the vessel. The fluidizing air structure is louvered or tiered so that adjacent layers or steps are separated by directionally oriented air discharge gaps by which fluidizing air is communicated from a surrounding plenum to the bed. When the plenum is pressurized, airflow is displaced in a downward and inward direction across the surface of the tiered structure, in combination with the force of gravity, to stimulate progressive removal of tramp from the bed without accumulation thereof. The tiered construction offers no structural impediment to bed material and tramp migrating downward toward a discharge site.

The geometry of the tiers is downwardly convergently tapered, and may comprise an inverted stepped cone or inverted stepped pyramid. The gap between each tier comprises air discharge sites which determine waveform, pressure drop and velocity of the airflow. There is no stagnant area on the surface of each plate, in the central lower region of the vessel or elsewhere, at which tramp could accumulate. Ultimately, each layer of air turns upward to support and fluidize the bed and ultimately passes from the vessel through an exhaust port. The geometry of the upper and lower portions of adjacent tiers and the associated gap are coordinated to nozzle airflow by which the bed is supported and fluidized. Preferably the pressure drop per tier progressively decreases in a downward direction.

Tramp and fluidized bed material, thus progressively delivered to the discharge site, are continuously released. Released material is separated into magnetic and non-magnetic components. The non-magnetic components are further separated into two groups, which comprise recyclable bed material, which is returned to the vessel, and nonmagnetic tramp.

It is a primary object of the present invention to provide a novel fluid bed incinerator, and related methods, which materially overcomes or alleviates the aforementioned problems of the prior art.

It is a paramount object to provide a novel fluid bed incinerator, and related methods, by which waste containing large amounts of difficult to handle noncombustibles or tramp can be processed.

It is another primary object of this invention to provide a novel fluidized bed vessel system, and related methods, for continuously incinerating combustible material comprising pieces of tires and concurrently removing tramp material.

It is a further important object to provide a fluidized bed vessel comprising structure at the bottom of the vessel which is not an impediment to removal of the tramp material through the bottom of the vessel without shut down.

It is a prime object to provide a fluidized bed vessel comprising bottom structure by which the bed is supported upon and fluidized by the cushion of air which also accommodates unencumbered passage throughout of tramp material.

Another paramount object is provision of a novel fluid bed comprising novel louver structure defining directional air ingress gaps which, in combination with the force of gravity, sweep tramp and bed material from the interior surfaces of the bottom.

It is a dominant object to provide bottom structure of a fluid bed vessel comprising an air distribution interior perimeter defining an open region within the perimeter.

Another significant object is the provision of a novel fluidized bed vessel comprising a louvered bottom louvers of which are slightly sloped inwardly and downwardly in respect to the horizontal.

It is a further prime object to provide for bottom air flow in a fluidized bed vessel which is directed from the periphery through the gaps inwardly and downwardly to aid the sweeping of tramp and other material from the surface interior of the bottom and which ultimately turns upward to support and fluidize the bed without the benefit of a centrally disposed air distributor system.

It is an elemental object to provide bottom structure in a fluid bed vessel which provides for unobstructed migration of tramp material which may comprise wire or other difficult to handle noncombustibles.

It is a fundamental object to control and balance airflow in a fluid bed vessel by geometry of the overlapping layers and gap spacing.

It is an important object to provide a plenum and compressor pump in a fluid bed vessel to provide a source of air which flows through the gaps into the vessel.

It is a key object to provide a vessel which has no moving parts.

It is an essential object to provide a combustion initiation system by which fluidized bed material temperature can be elevated to initiate combustion.

It is a further integral object to provide a discharged material handling system for a fluid bed vessel which provides for delivery and further processing of tramp and entrapped fluidizable bed material from the vessel.

It is an important object to provide a discharge chute means in a fluid bed vessel which comprises a lockhopper means to control tramp and exhaust discharge.

It is a significant object to separate magnetic tramp from non-magnetic tramp and to further separate recyclable fluidizable material from non-magnetic tramp.

It is a further key object to provide a system for recycling bed material from a fluid bed vessel, through a segregation site and back to the vessel.

It is a significant object to provide a fluidized bed vessel incineration system which provides sensing and control of the content of exhaust gases.

It is a further significant object to provide for separating particulates from the exhaust gases before release of gases to the atmosphere.

It is a basic object to provide for combustible waste fuel delivery to a fluid bed vessel which allows no exhaust gas leakage from the vessel.

It is a further basic object to provide for delivery of waste fuel to a fluid bed vessel which provides uniform dispersal of fuel to the vessel and which can deliver fuel, recycled fluidizable material, and reclaimed particulates from an exhaust gas particulate separation system.

It is an important object to provide for energy transfer to transform energy produced by combustion to a reusable form.

It is another paramount objective to provide a novel fluid bed apparatus, and related methods, comprising a novel air distributor which is centrally hollow and which supports and fluidizes the bed using a plurality of air layers.

It is a further significant object to provide a novel air distributor for a fluid bed vessel which prevents accumulation of tramp, including wire, and continuously migrates the same to an outlet site and which issues a plurality of downwardly and inwardly directed layers or streams of air which change direction to support and fluidize the bed.

These and other objects and features of the present invention will be apparent from the detailed description taken with reference to accompanying drawings.

DETAILED DESCRIPTION OF THE ILLUSTRATED EMBODIMENT

Figure 1:
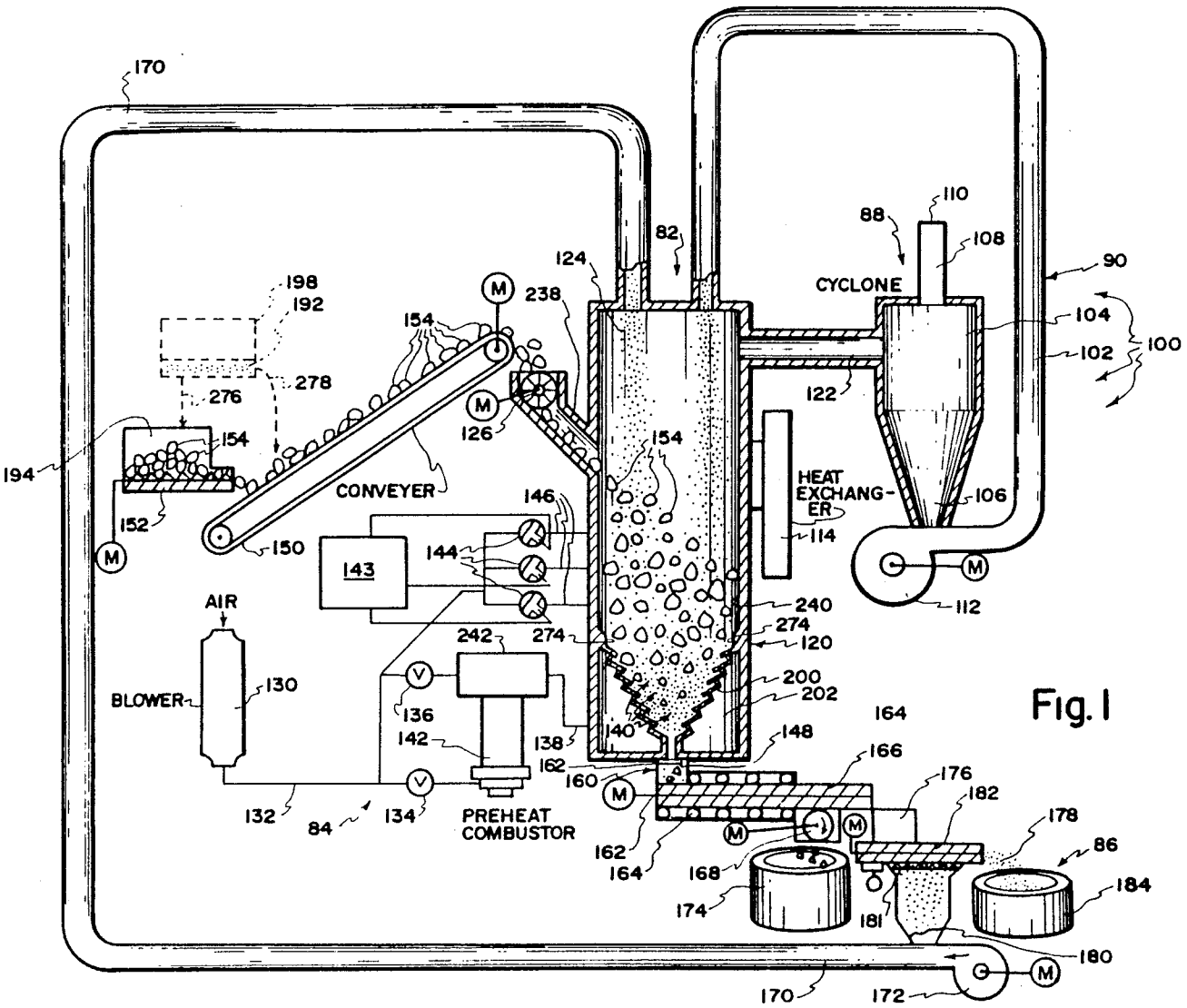
FIG. 1 is a schematic of a continuously processing fluidized bed incineration system according to the present invention with some parts shown as line representations and others in cross-section for clarity.

Specific reference is now made to the drawings wherein like numerals are used to designate like parts throughout. One presently preferred embodiment of the present invention, generally designated system 100, is illustrated in FIGS. 1–5.

Broadly, system 100 comprises a fuel material delivery system, generally designated 80, a fluid bed vessel system, generally designated 82, an air delivery system, generally designated 84, a bed and tramp removal segregation and recycle system, generally designated 86, and an off-gas processing system, generally designated 88, including a particulate feedback system 90.

The air delivery system 84 comprises air blower 130. Air blower 130 provides all airflow required in vessel 120 of the fluid bed vessel system 82. While system 100 is operating, blower 130 provides the airflow needed to support and fluidize the bed contained in the bottom of the vessel. This flow occurs through a feed line 132 across a valve 136 through a heating chamber 242 of a preheat combuster 142 and into a vessel plenum 202 via a feed line 138. As well, parallel valves 144 mix and meter emission control gases comprising ammonia and oxygen, when and as necessary, from source 143 with effluent air from blower 130, thereby accommodating delivery of these gases to influent ports at the distal ends of feed lines 146. Injection of ammonia controls NOx emission levels.

Combustion in the vessel 120 is initiated by use of the preheat combuster 142 of the air delivery system 84. To achieve self sustaining combustion, air blower 130 is turned on and air, discharged from line 138, enters the plenum 202 to pneumatically support and fluidize the bed 140 in vessel 120, as explained in greater detail hereinafter. Further, valve 134 of the air delivery system 84 is opened to provide a supply of air to preheat combuster 142, which is also activated. Preheat combuster 142 is maintained in an activated condition until the temperature in the fluidized bed 140 of vessel 120 reaches the desired temperature, for example, 600 to 1000 degrees Fahrenheit. Waste fuel particles 154, such as tire chips, are delivered at a desired metered rate to the interior of the vessel, as explained later in greater detail. This waste fuel ignites and burns during start up. Once operating temperature is achieved in the vessel, combustion becomes self-sustained, without need for heat from the preheat combuster 142. Therefore, at this time, valve 134 is closed and preheat combuster 142 is deactivated.

The nature, make-up and size of tire chips require a relatively long dwell or residence time in the bed for complete incineration of the combustibles thereof. It is presently preferred that the size of the tire chips be three inches in any direction or less.

Under normal self-sustained combustion conditions, air pressure in plenum 202 which surrounds fluid bed louvered air distributor 200, is preferably maintained near 55 inches of water. Airflow which supports and fluidizes the bed material 140 sustains a pressure drop of typically 12 to 15 inches of water as it flows through the gaps or slots between the louvers or tiers of the air distributor 200, as hereinafter explained in greater detail.

The fuel material delivery system 80, as illustrated, comprises a waste fuel receiving hopper 194 equipped with a variable speed motor-driven screw conveyor 152 in the bottom thereof. System 80 also comprises belt conveyor 150, which receives waste fuel from the screw conveyor 152 and transports the same to a discharge site at metered rates. When desirable to capture sulfur and to control $SO_2$ emissions, limestone 192 in hopper 198 may be added at desired rates, as at 276, to the fuel particles 154 to hopper 194 or, as at 278, directly to conveyor 150. System 80 also comprises rotary seal feeder 126, and stoker/spout 238 by which fuel (and limestone, when used) material effluent from conveyor 150 is introduced into the upper vapor space of the vessel 120. Hopper 194 receives, stores and selectively delivers at a metered rate waste fuel particles 154 to belt conveyor 150. When tires are to be combusted, they are preshredded (cut into pieces or chips) before being deposited into hopper 194.

As is widely known, the reaction between the $SO_2$ and the limestone and the parallel calcining reaction of limestone to lime are optimized between 1500 and 1650 degrees Fahrenheit. In a fluid bed, the limitation for sulfur capture becomes the contact time, or relative concentrations, between $SO_2$ gas and the CaO solid reactants. Thus, to the extent sulfur is present in the waste fuel, a metered amount of the influent limestone is added to the fuel influent to the vessel.

Waste fuel particles and limestone from hoppers 194 and 198 are illustrated as being delivered by belt conveyor 150 to rotary seal feeder 126 which delivers the same through the stoker/spout 238 and into the vessel 120 without allowing material gaseous emission to the atmosphere. Fuel and limestone, when used, fall from stoker/spout 238 into the vapor space or overfire region 124 of the vessel 120 in such a way as to be distributed in a substantially uniform way across the top of the fluidized bed 140. Fuel combustion occurs as the waste fuel particles migrate through the fluidized bed.

Combustion products delivered from the vapor space 124 of the vessel 120 to the off-gas processing system 88 primarily comprise $SO_2$ (previously mentioned), NOx, CO, $CO_2$ and $H_2O$. Of these, $CO_2$ and $H_2O$ are acceptable products of combustion and are not dealt with further. Control of $SO_2$ is discussed above. Carbon monoxide is a product of incomplete combustion, usually related to an oxygen deficiency. Secondary oxygen influx may be supplied from air blower 130 through a selected valve 144 and associated feed line 146 to reduce carbon monoxide emission levels.

The nitrogen combustion byproducts, general designated NOx, primarily occur from the conversion of fuel bound nitrogen. With combustion temperatures ranging between 1650 and 1800 degrees Fahrenheit, the occurrence of air fixation of nitrogen to NOx is almost nonexistent. As stated above emission of NOx is reduced by injection of ammonia, $NH_3$, from source 143. Ammonia reacts with NOx to form nitrogen gas and steam.

Energy of combustion can be transformed into a more useful form by use of a conventional suitable heat exchanger 114, diagrammatically illustrated in FIG. 1. Heat exchanger 114 preferably comprises tubes or pipes placed directly in the combuster or vessel although not shown in order to provide improved clarity. However, any heat exchanger by which heat is generated within the vessel can be reclaimed may be used.

Exhaust or flue gases delivered to the vapor space 124 thereafter flow through an exhaust channel 122 to a refractory-lined cyclone 104 in the illustrated embodiment. Alternatively, the off-gas from vapor space 124 may be delivered directly into an off-gas boiler for heat recovery purposes. Cyclone 104, when used, separates solid particulates from gases which flow outward to the atmosphere through exhaust chimney 108 and exhaust port 110. Separated particulates are recovered through cyclone base section 106 and are illustrated as being delivered to particulate blower 112 which transports the particulates along conduit 102 to vessel 120. Optionally, the physical arrangement of any off-gas processing system can be positioned so that particulates are returned to the vessel by force of gravity. As is conventional, solid particulates or some of them may also be collected for disposal at the output of cyclone base section 106.

As tire segments 154 or other combustible fuel particles are fed into fluidized bed 140, combustion in the bed occurs. For tires, the non-combustible residue (tramp) is primarily fragments of steel reinforcing wires which have a tendency to attach and collect on any structural edge or in any stagnant area which lies in their path. The geometric dimensions of wire, being long and thin, also contribute to collection of wire masses in areas in which there is little motivating force. The larger a wire mass grows, the more difficult it becomes to fluidize the bed and the more difficult it becomes to dislodge and discharge the wire. Solid combustion residue or noncombustibles (tramp) typically amount to approximately 10 percent by weight for shredded tires. To facilitate movement, without the use of moving parts, fluidized bed bottom 200 of vessel 120 is novelly constructed in a sloped, louvered or tiered format with air influent directionally disposed passageways between the louvers or tiers.

Figure 2:
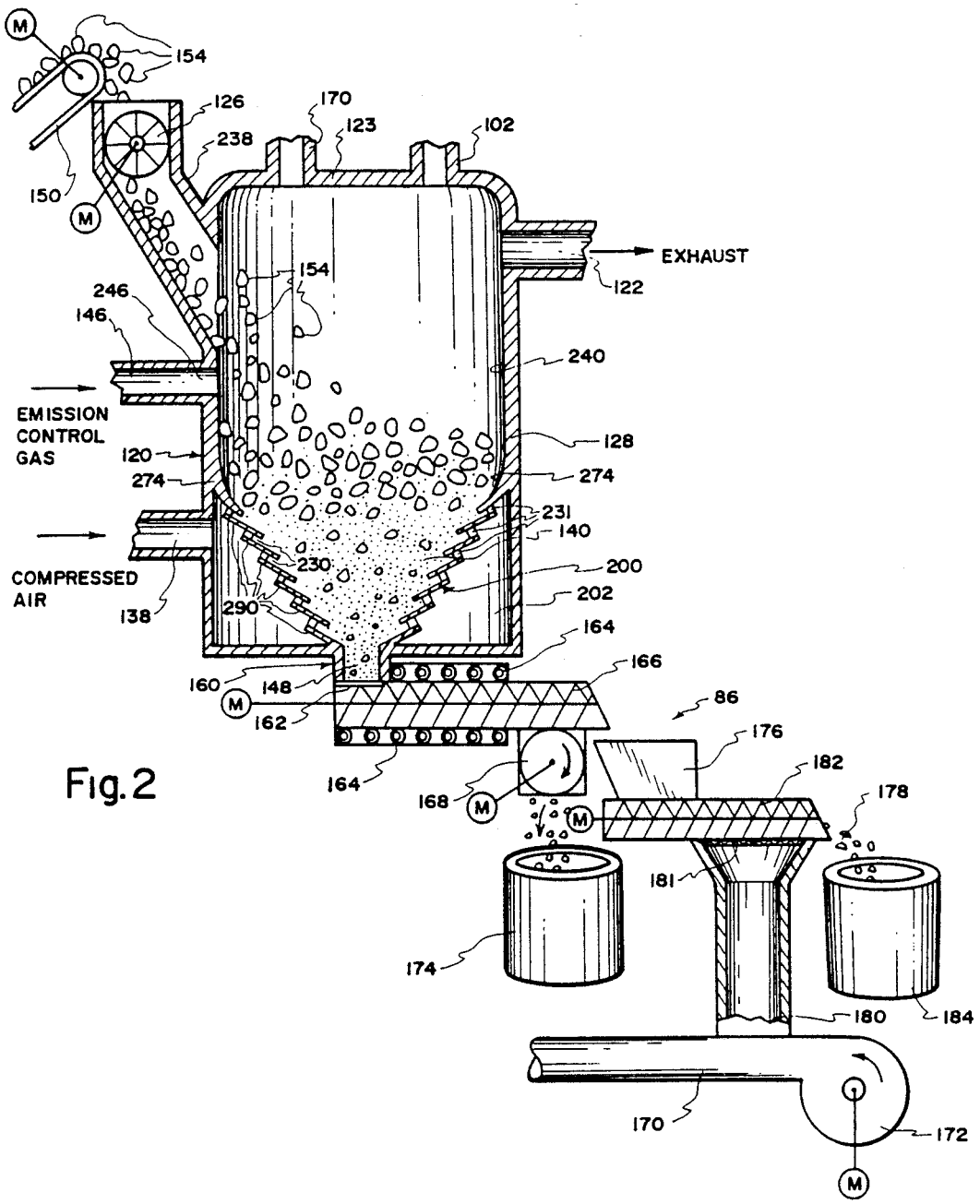
FIG. 2 is an enlarged fragmentary schematic vertical cross-section of the incinerating fluid bed vessel and tramp and bed material removal and separation system of the embodiment of FIG. 1.
Figure 3:
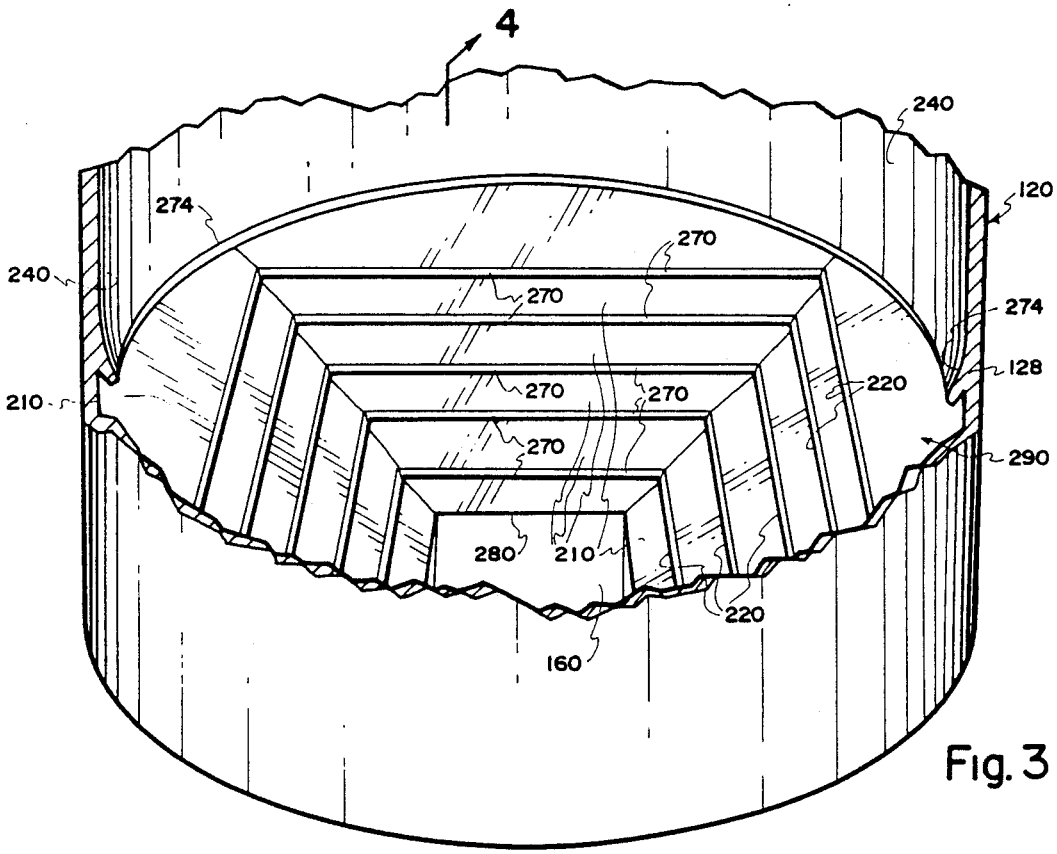
FIG. 3 is an enlarged fragmentary perspective of the bottom air distributor of the vessel of FIG. 1 showing louvers or tiered plates, separated by sized and directionally oriented gaps through which fluidizing air flows.
Figure 4:
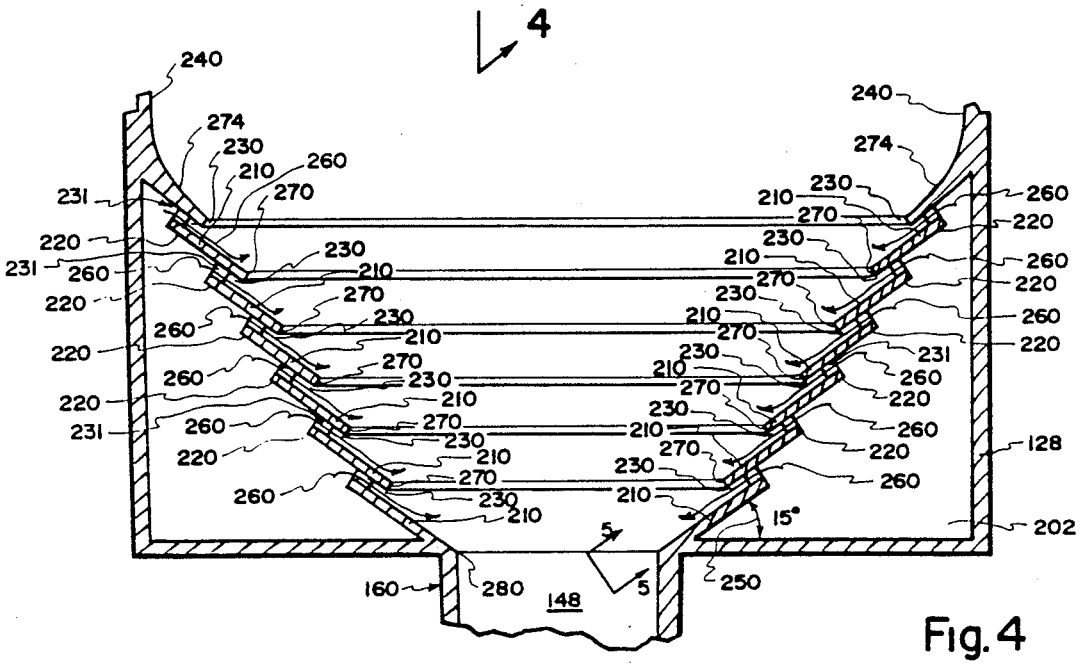
FIG. 4 is a cross sectional view taken along line 4—4 of FIG. 3.

As best seen in FIG. 2, tiered air distributor 200 of the vessel 120 is surrounded by a plenum 202, which provides a reservoir of compressed air, the source of which is air blower 130. As seen in FIGS. 3 and 4, the overlapping plates, tiers or louvers 274 and 290, which are illustrated as being planar but may also be of a curved form, provide no obstruction to the migration of tramp downwardly and inwardly through the air supported and fluidized bed to a centrally disposed discharge chute 160. While the shape of the tiered air distributor 200 preferably comprises an inverted pyramid or an inverted cone, other forms may be utilized without departing from the scope of the present invention.

Each tier plate 274 and 290 comprise a top surface 210, a bottom surface 220, sequential spacer blocks 231 and gaps or spaces 230 each disposed between the top and bottom plate surfaces 274 and 290, and leading edges 270. The plates 274 and 290 are sloped to accommodate unencumbered tramp movement under force of gravity and air displacement to the outlet site 148 of the vessel 120. The presently preferred slope is on the order of 15 degrees from horizontal. The air distributor 200 is directly connected, as by welding, to vessel 120 namely to inner wall 240 at top tier 274 at the lowest bottom tier plate 290 which angularly interconnects with the vertical discharge chute 160 forming edge 280.

As shown in FIG. 4, the overlapping placement of louver or tier plates 274 and 290 creates gaps 230, each of which is a fluidizing air communicating channel from plenum 202. Air, initially vectored downwardly and inwardly in the direction of the top surface 210 of the next lower tier plate 290 is emitted through each gap 230. Spacer blocks 231 are disposed between adjacent side-by-side gaps 230 and define the width of each gap 230. Adjacent spacer plates 231 are contiguous with and welded to the juxtaposed top and bottom tier plates 290 and comprise surfaces at and defining the gap 230 therebetween. These surfaces may be flat or curved, parallel or nonparallel, depending on the type nature and characteristics of effluent fluidizing air desired from the gaps 230 in the bed. A nozzle-like air flow from the gaps 230 has been found to effectuate a scouring of tramp from the tier plates to enhance total removal of tramp including tire wire from the bed and vessel. The vessel 120, the tier plates 290 and the spacer blocks 231 may be temperature resistant steel and may be refractory coated or lined.

Spacing each top surface 210 of each tier plate 290 relative to the bottom surface 220 of the next tier plate set by spacer blocks 231 allows air flow through each gap 230 from the plenum 202 and defines the direction velocity and flow pattern of streams comprising a layer of air emitted across each top surface 210. It is important that air velocity be adequate in combination with the force of gravity, to sweep wire and/or other tramp from the top surface 210 of each tier plate during operation. The velocity may be periodically increased for a short time by increasing the air pressure in plenum 202 to insure dislodgement of tramp. The airflow pattern from the air distributor 200 must be such that there is no material area of air flow stagnancy across any top surface 210. Because resistance to air flow varies as a function of bed depth and the distance from the internal perimeter 240 of vessel 120, the cross sectional geometries of gaps 230 are typically varied to make surface flow substantially uniform throughout vessel 140. Preferably, the pressure drop in each layer of air flow experiences a progressive decrease in a downward direction in order to support and fluidize the bed. The downward and inward flow of air as superimposed layers of flow directly lifts and displaces tramp material which would otherwise collect on the top surfaces 210, continuously urging the tramp downward and inward until it drops passed the edge 280 into discharge chute 160.

Air flow from the gaps 230, generally designated by flow lines and arrows 260, moves across each plate top surface 210. It is maintained in this direction by forces comprising initially directed flow velocity and boundary layer phenomenon. Other forces comprising summation of all internally directed flow vectors, direction of least resistance to flow upward in vessel 20, and distributive forces of the fluidized bed 140 cause the initially downwardly directed airflow to turn upward. Surprisingly, upwardly flowing layers of air not only supports but essentially uniformly fluidizes the bed 140. Plenum pressure is typically 55 inches of water, and the pressure drop across the gaps 230 is 12 to 15 inches of water.

Again referencing FIG. 2, upwardly flowing air emanating from gaps 230 supports and fluidizes the bed 140 and also provides oxygen for combustion taking place in vessel 120. The wall 128 of vessel 120, which may be refractory lined, beginning at off-gas outlet 122 adjacent top 123 extends uninterrupted downward to tip tier plate 274 at the top of the air distributor 200, except for portals for stoker/chute 238 and inlet ports 246 for emission control feed lines 146. Top tier plate 274 smoothly extending inwardly and downwardly from inner wall 240 of vessel 120 centrally divergently deflects bed material and tramp migrating toward the outlet 160. The gaps 230 disposed between the bottom of interface plate 274 and top surface 210 of highest plate 290 provides inwardly blowing air flow further urging tramp inwardly and downwardly off the top layer. The vessel wall 128 below plate 274, as illustrated, is interrupted only by the influent part for conduit 138.

Tramp which so migrates into the discharge chute 160 is accompanied by bed material. Bed material and tramp, collectively identified as 148, fall into discharge chute 160 and collect above lockhopper 162, when used. Lockhopper 162 provides a gas seal for vessel 120. The bed material is comprised primarily of inert, refractory sand. It is to be appreciated that lockhopper 162 may or may not be used. If not used, discharge conveyor speed is set to establish the rate at which material is discharged through chute 160.

An important feature of the present invention is the bed recycling system, which typically recycles bed material at a relatively high rate. Recovery of discharged bed material and disposal of segregated tramp begins at lockhopper 162. Lockhopper 162 is periodically opened, depositing the contents 148 contained in chute 160 into the interior of an auger mechanism 166. A cooling coil 164 reduces the temperature of the bed and tramp material 148 to a level which will not damage a magnetic drum 168, used in the tramp separation process. The currently preferred temperature at auger 166 is about 600 degrees Fahrenheit. Once the temperature of the bed/tramp effluent 148 is so reduced, it is passed over magnetic drum 168 which removes wire and/or any other magnetic parts thereof and deposits the removed magnetic tramp in a waste receptacle 174. The remaining non-magnetic residue is moved by screw conveyor 166 to open top hopper 176 then along screw conveyor 182. A conventional vibrating screen 181 screens bed material into hopper 180. Screen size is selected to be consistent with bed material grain size. The recycled bed material is delivered to the vessel 120 along return line 170 under force of blower 172. Nonmagnetic tramp 178 is delivered by screw conveyor 182 to waste receptacle 184.

Figure 6:
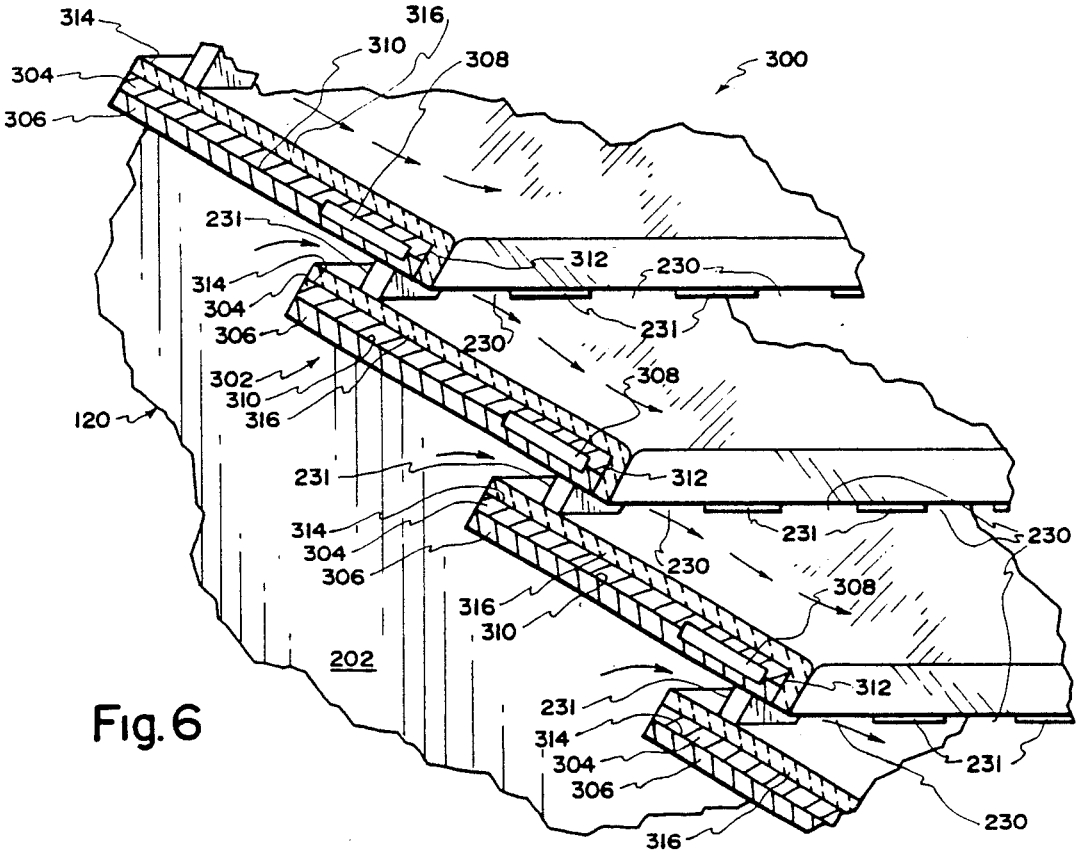
FIG. 6 is an enlarged fragmentary cross-section of refractory coated, air or water cooled louvers or tiered plates of a modified form of the present invention.
Figure 5:
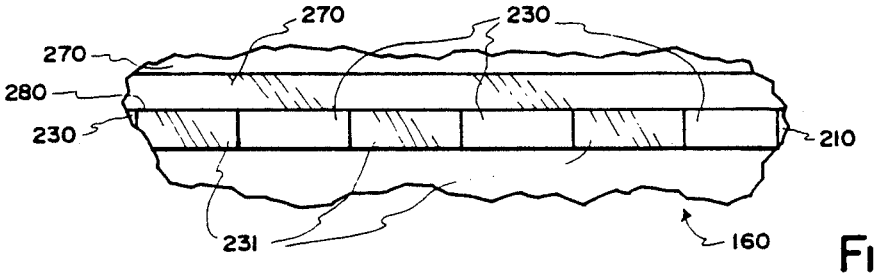
FIG. 5 is a view taken along lines 5—5 of FIG. 4.

Reference is now made to a second presently preferred embodiment in accordance with the present invention, shown in FIG. 6 and generally designated 300. Fluid bed system 300 comprises an air distributor 302, which is configurated and functions as heretofore described in conjunction with the embodiment of FIGS. 1–5 unless otherwise hereafter indicated. Specifically, the air distributor 302 is of an inverted pyramid configuration having the same essential stepped or tiered configuration described in conjunction with the embodiment of FIGS. 1 through 5. Each tier comprises a pair of contiguous plates, i.e. top plate 304 and bottom plate 306, which are welded together and define a coolant passageway 308 at the interface 310 therebetween. Each coolant passageway 308 is located adjacent the distal end 312 of each dual plate tier. Coolant, in the form of air or liquid, such as water, is displaced using a conventional coolant drive system, through the passageways 308 to cool the air distributor 302.

Each top plate 304 is illustrated as being coated or covered at the top surface 314 thereof with a layer of refractory material 316, the purpose of which is likewise to reduce the temperature to which the air distributor 302 is subjected.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A fluid bed system for incineration of tire segments containing wire and other waste fuel containing difficult to handle tramp, the fluid bed system comprising:

a vessel having a lower portion, fuel influent means, exhaust gas means and tramp and bed effluent means;

peripheral air distributor means disposed within the vessel at the lower portion thereof, the air distributor means being disposed only at the periphery of the bed which define a centrally unobstructed hollow bed material and tramp migration region directly above the tramp and bed effluent means;

a fluid bed for incineration of the waste fuel disposed in the central substantially hollow region of the air distribution means;

the peripheral air distributor means comprising air plenum means being peripherally disposed in space relation to the bed to which compressed air is delivered, the lower portion of the vessel comprising downwardly and inwardly staggered tier surfaces directly juxtaposed the fluid bed and a plurality of centrally and downwardly directed fluidizing air discharge means interposed between adjacent tier surfaces and through which compressed air from the air plenum means is directed across tier surfaces from the periphery into the central hollow region of the air distributor means as plurality of spaced streams whereby the bed is supported upon and fluidized by said streams of directed air and migration of tramp and bed material through the central region to the tramp and bed effluent means is accommodated.

2. A fluid bed system according to claim 1 wherein each staggered tier surface is sloped downwardly and inwardly.

3. A fluid bed system according to claim 2 wherein the tier surfaces are parallel to each other and each is disposed at a slope on the order of 15 degrees in respect to the horizontal.

4. A fluid bed system according to claim 1 wherein the air discharge means comprise a plurality of spaced gaps.

5. A fluid bed system according to claim 4 wherein the spaced gaps are defined by spacer means selectively interposed between adjacent tiers.

6. A fluid bed system according to claim 1 wherein each staggered tier surface is sloped downwardly and inwardly and the air discharge means are disposed so that influent fluidizing air therefrom initially flows substantially parallel to and along the tier surface.

7. A fluid bed system according to claim 1 comprising means selectively accommodating discharge of bed material and tramp through the tramp and bed effluent means.

8. A fluid bed system according to claim 1 further comprising means receiving bed material and tramp discharge through the tramp and bed effluent means and means segregating the bed material from the tramp.

9. A fluid bed system according to claim 8 wherein the segregating means comprise means separating magnetic tramp, nonmagnetic tramp and bed material into independent constituents.

10. A fluid bed system according to claim 9 comprising means recycling discharged and separated bed material to the fluid bed.

11. A fluid bed system according to claim 1 wherein the fuel influent means comprise means by which supplemental bed material is selectively introduced into the vessel.

12. A fluid bed system according to claim 1 wherein the fuel influent means comprise means by which limestone is selectively introduced into the vessel.

13. A fluid bed system according to claim 1 wherein heat exchange means are associated with the vessel by which heat is recovered from incineration within the vessel.

14. A fluid bed system according to claim 1 comprising means by which ammonia is selectively introduced into the vessel above the bed.

15. A fluid bed system according to claim 1 wherein at least some of the vessel at the interior thereof comprises refractory material.

16. A fluid bed system according to claim 1 wherein at least some of the tier surfaces comprise refractory material.

17. A fluid bed system according to claim 1 wherein structure which defines the tier surfaces also comprises coolant passageway means for controlling temperature to which the air distributor means is subjected.

18. A fluid bed system according to claim 1 wherein the tier surfaces and the size, distribution and location of the air discharge means cause a pressure drop in each stream of fluidizing air which progressively decreases in a downward direction.

19. A fluid bed system according to claim 1 wherein the overall configuration of the air distributor means generally comprises an inverted stepped cone.

20. A fluid bed system according to claim 1 wherein the overall configuration of the air distributor means generally comprises an inverted stepped pyramid.

21. A fluid bed system for incineration of waste fuel comprising a vessel, waste fuel influent means for the vessel, fluid bed means within the vessel, gas exhaust means for the vessel, bed and tramp exit means, and air distributor means disposed only around the perimeter of the fluid bed means to which air under pressure is delivered, the air distributor means comprising downwardly and inwardly tapered perimeter surface means defining a substantially hollow relatively large centrally unobstructed passageway for downward migration of bed material and tramp to and through the bed and tramp exit means, the surface means being interrupted by a plurality of stepped rows of centrally and downwardly directed vertically spaced air influent sites through which said air under pressure is introduced into the bed to support combustion and support and fluidize the bed, the stepped rows of air influent sites being located in vertically spaced horizontal planes, each row being offset both horizontally and vertically form the preceding row.

22. The system of claim 21 wherein each air influent site comprises means causing air passing therethrough to be downwardly and inwardly directed along a path initially substantially parallel to the adjacent surface means.

23. A vessel comprising a fluid bed for continuously incinerating fuel comprising tire segments and the like which comprise metallic wire tramp and for concurrently removing tramp and bed materials at a bottom effluent exit means of the vessel, the vessel further comprising static air distributor means at the periphery of the bed comprising a substantially centrally unobstructed relatively large central region in which the fluid bed and fuel only are disposed and through which bed material and tramp migrate without obstruction to and through the effluent exit means, downwardly and inwardly stepped lower vessel wall means and a plurality of peripherally located centrally directed vertically and horizontally offset spaced air influent means surrounding the central region and associated with the stepped lower vessel wall means by which the bed is supported and fluidized.

* * * * *